US008550613B2

(12) United States Patent
Ito

(10) Patent No.: US 8,550,613 B2
(45) **Date of Patent: *Oct. 8, 2013**

(54) LIQUID EJECTING HEAD

(75) Inventor: Takashi Ito, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 66 days.

This patent is subject to a terminal disclaimer.

(21) Appl. No.: 13/028,165

(22) Filed: Feb. 15, 2011

(65) Prior Publication Data

US 2011/0199445 A1 Aug. 18, 2011

(30) Foreign Application Priority Data

Feb. 15, 2010 (JP) ..... 2010-029800

(51) Int. Cl.
*B41J 2/175* (2006.01)

(52) U.S. Cl.
USPC ..... 347/93

(58) Field of Classification Search
None
See application file for complete search history.

(56) References Cited

U.S. PATENT DOCUMENTS

| | | | | |
|---|---|---|---|---|
| 6,830,325 | B2 * | 12/2004 | Hirota et al. | 347/94 |
| 2003/0156162 | A1 | 8/2003 | Hirota et al. | |
| 2005/0036005 | A1 | 2/2005 | Chikamoto | |
| 2005/0116989 | A1 | 6/2005 | Chikamoto | |
| 2005/0157104 | A1 | 7/2005 | Hirota et al. | |
| 2007/0139484 | A1 * | 6/2007 | Taira et al. | 347/68 |
| 2007/0139498 | A1 | 6/2007 | Chikamoto et al. | |
| 2007/0252877 | A1 | 11/2007 | Okubo | |
| 2008/0239040 | A1 | 10/2008 | Umeda | |
| 2009/0219334 | A1 | 9/2009 | Yamamoto | |
| 2010/0073446 | A1 * | 3/2010 | Shimizu | 347/93 |

FOREIGN PATENT DOCUMENTS

| | | | |
|---|---|---|---|
| CN | 1442304 | A | 9/2003 |
| CN | 1579768 | A | 2/2005 |
| EP | 0924077 | A2 | 6/1999 |
| EP | 1798040 | A1 | 6/2007 |
| JP | 2000-103075 | A | 4/2000 |
| JP | 2004-114335 | A | 4/2004 |

(Continued)

OTHER PUBLICATIONS

European Patent Office, extended European Search Report for European Patent Application No. 11000790.3 (counterpart to above-captioned patent application), dated Apr. 19, 2011.

(Continued)

*Primary Examiner* — Matthew Luu
*Assistant Examiner* — Renee I Wilson
(74) *Attorney, Agent, or Firm* — Baker Botts L.L.P.

(57) ABSTRACT

A liquid ejecting head having a forward passage system extending from a liquid inlet opening to liquid-droplet ejecting nozzles, a first filter and a second filter disposed in series with each other in the forward passage system to capture foreign matters in the liquid, such that the first filter is located upstream of the second filer as seen in a direction of flow of the liquid through the forward passage system, a first return passage system extending from one of opposite surfaces of the first filter which is on an upstream side as seen in the direction of flow of the liquid, to a first liquid outlet opening different from the inlet opening, and a second return passage system extending from one of opposite surfaces of the second filter which is on an upstream side as seen in the direction of flow of the liquid, to a second liquid outlet opening different from the first outlet opening.

11 Claims, 8 Drawing Sheets

(56) References Cited

FOREIGN PATENT DOCUMENTS

| | | | |
|---|---|---|---|
| JP | 2005-132036 | A | 5/2005 |
| JP | 2005-169839 | A | 6/2005 |
| JP | 2006-159432 | A | 6/2006 |
| JP | 2007-160822 | A | 6/2007 |
| JP | 2008-238584 | A | 10/2008 |
| JP | 2009-051046 | A | 3/2009 |
| JP | 4239459 | B2 | 3/2009 |
| JP | 2009-208368 | A | 9/2009 |

OTHER PUBLICATIONS

Japan Patent Office, Notification of Reason for Refusal for Japanese Patent Application No. 2010-029800 (counterpart Japanese patent application), mailed Apr. 2, 2013.

The State Intellectual Property Office of the People'S Republic of China, Notification of First Office Action for Chinese Patent Application No. 201110034296.5 (counterpart Chinese patent application), issued Apr. 2, 2013.

* cited by examiner

LIQUID EJECTING HEAD

CROSS REFERENCE TO RELATED APPLICATION

The present application claims the priority from Japanese Patent Applications No. 2010-029800 filed Feb. 15, 2010, the disclosure of which is herein incorporated by reference in its entirety.

BACKGROUND OF THE INVENTION

1. Field of the Invention

The present invention relates to a liquid ejecting head configured to eject droplets of a liquid such as an ink.

2. Description of Related Art

An ink-jet head known as an example of a liquid ejecting head has an ink inlet through which an ink is introduced from an ink tank, a multiplicity of ink-ejecting nozzles open in an ink-ejecting surface to eject droplets of the ink, and ink passages extending from the ink inlet to the ink-ejecting nozzles. To capture foreign matters (such as air bubbles and dust) contained in the ink within the ink-jet head, that is, to filter the ink, it is known to provide a filter one of the ink passages. By this filter, the foreign matters in the ink are captured before the ink flows to the ink-ejecting nozzles, to prevent dwelling of the foreign matters near the ink-ejecting nozzles, and consequent deterioration of the ink-ejecting function of the ink-jet head.

SUMMARY OF THE INVENTION

There has been a need to increase the printing efficiency of the ink-jet head. To satisfy this need, it is necessary not only to increase the number of the ink-ejecting nozzles, but also to improve the efficiency of capturing the foreign matters within the ink passages. Where only one filter is disposed within the ink-jet head, however, the improvement of the efficiency of capturing the foreign matters by reducing the mesh size (diameter) of the filter is limited.

To improve the efficiency of capturing the foreign matters, it is considered to increase the number of the filters disposed in the ink passages, for example, to dispose one filter in an upstream one of the ink passages and another filter in a downstream one of the ink passages. However, the provision of the two or more filters may cause various drawbacks, such as a need of discharging the foreign matters deposited on the filters, out of the ink passages, in order to prevent an increase of the resistance of ink flows through the ink passages. To overcome the drawbacks, it is necessary to perform purging operations for forcibly introducing the ink from the ink tank into the flow passages to discharge the foreign matters deposited on the filters, together with the ink. However, the purging operations usually require a relatively large amount of consumption of the ink.

The present invention was made in view of the background art described above. It is therefore an object of the present invention to provide a liquid ejecting head which is configured to satisfy both the need of improving the efficiency of capturing the foreign matters within liquid flow passages, and the need of reducing the amount of consumption of the liquid required for discharging the foreign matters deposited on each filter.

The object indicated above can be achieved according to the principle of this invention, which provides a liquid ejecting head comprising: defining a forward passage system extending from an inlet opening to which a liquid is supplied from a liquid supply source, to a plurality of liquid-droplet ejecting nozzles; a first filter and at least one second filter disposed in series with each other in the forward passage system to capture foreign matters contained in the liquid, such that the first filter is located upstream of the at least one second filer as seen in a direction of flow of the liquid through the forward passage system; a first return passage system extending from one of opposite surfaces of the first filter which is on an upstream side as seen in the above-indicated direction of flow of the liquid, to a first outlet opening from which the liquid is discharged and which is different from the inlet opening; and defining a second return passage system extending from one of opposite surfaces of the at least one second filter which is on an upstream side as seen in the above-indicated direction of flow of the liquid, to a second outlet opening from which the liquid is discharged and which is different from the first outlet opening.

BRIEF DESCRIPTION OF THE DRAWINGS

The above and other objects, features, advantages and technical and industrial significance of the present invention will be better understood by reading the following detailed description of a preferred embodiment of the present invention, when considered in connection with the accompanying drawings, in which:

FIGS. 5A, 5B and 5C are views indicating ink flows through the ink-jet head of FIG. 1 during a printing operation of the ink-jet head, wherein FIG. 5A is a fragmentary cross sectional view of a first chamber of a filter unit, and FIG. 5B is a fragmentary cross sectional view of a second chamber of the filter unit, while FIG. 5C is a fragmentary exploded perspective view of the filter unit and a reservoir unit;

FIGS. 6A, 6B and 6C are views indicating ink flows through the ink-jet head of FIG. 1 during a nozzle purging operation of the ink-jet head, wherein FIG. 6A is a fragmentary cross sectional view of the second chamber of the filter unit, and FIG. 6B is a fragmentary cross sectional view of the first chamber of the filter unit, while FIG. 6C is a fragmentary exploded perspective view of the filter unit and the reservoir unit;

FIGS. 7A and 7B are views indicating ink flows through the ink-jet head of FIG. 1 during a circulation purging operation of the ink-jet head, wherein FIG. 7A is a fragmentary cross sectional view of the second chamber of the filter unit, and FIG. 6B is a fragmentary cross sectional view of the first chamber of the filter unit; and FIGS. 8A, 8B and 8C are views indicating ink flows through the ink-jet head of FIG. 1 during an inter-filter purging operation of the ink-jet head, wherein FIG. 8A is a fragmentary cross sectional view of the second chamber of the filter unit, and FIG. 8B is a fragmentary cross sectional view of the first chamber of the filter unit, while FIG. 8C is a fragmentary exploded perspective view of the filter unit and the reservoir unit.

DETAILED DESCRIPTION OF THE PREFERRED EMBODIMENTS

The preferred embodiment of this invention will be described by reference to the accompanying drawings.

Figure 1:
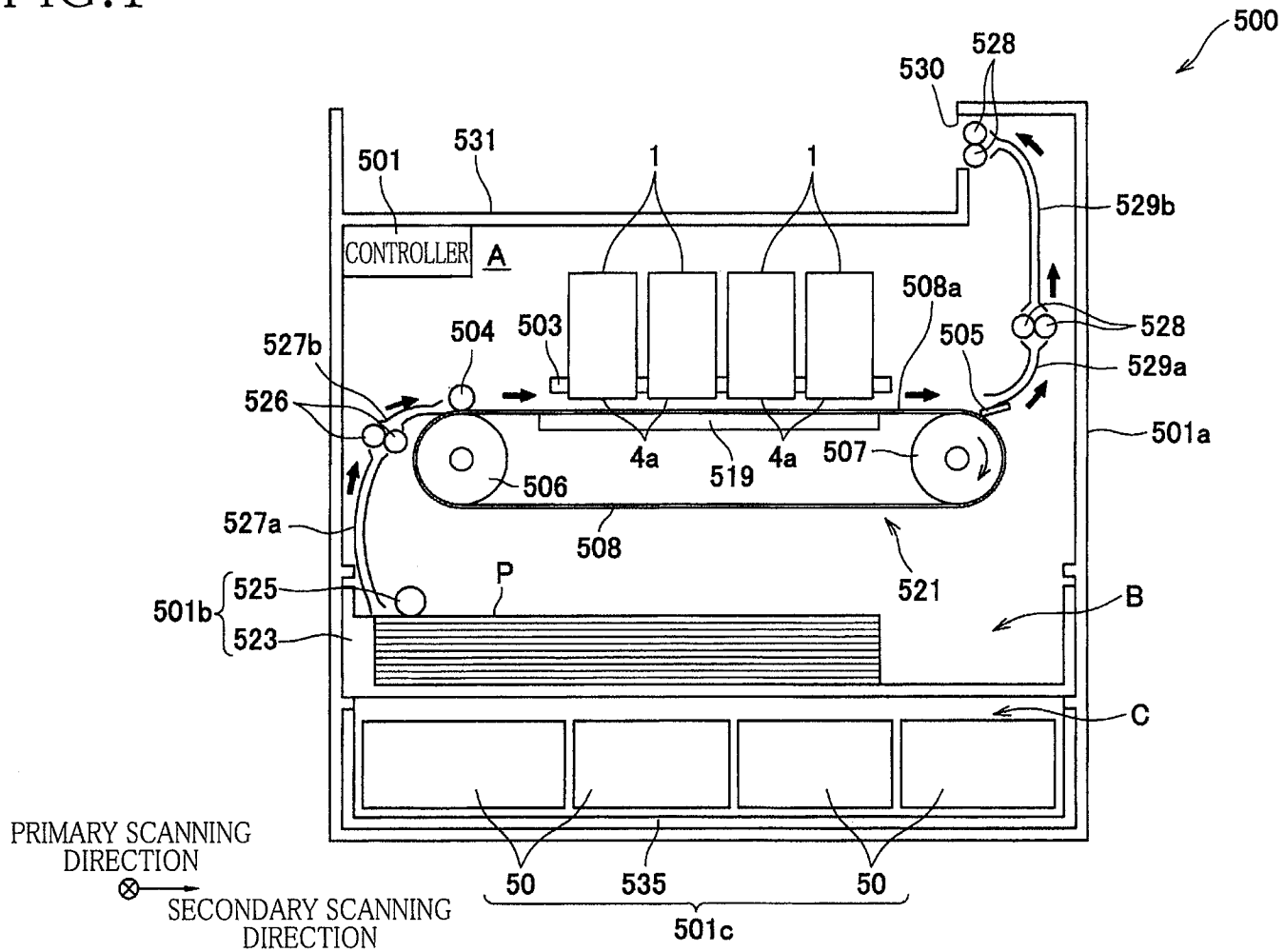
FIG. 1 is a schematic side elevational view of an ink-jet type printer including an ink-jet head as a liquid ejecting head constructed according to a first embodiment of this invention.

Referring first to the schematic side elevational view of FIG. 1, there is shown a printer 500 of an ink-jet type including four ink-jet heads 1 each constructed as a liquid ejecting head constructed according to the preferred embodiment of the present invention. Each of the ink-jet heads 1 is a so-called "line printing head" disposed so as to extend in one direction (direction perpendicular to the plane of the view of FIG. 1). That is, each ink-jet head 1 has its longitudinal direction that is a primary scanning direction, which is perpendicular to a secondary scanning direction in which the four ink-jet heads 1 are arranged in the ink-jet printer 500 of the line printing type.

The printer 500 has a housing 501*a* in the form of a generally rectangular parallelepiped having a top wall that serves as a sheet receiver 531. The housing 501*a* has three functional spaces A, B and C arranged in the order of description in the downward direction. A sheet transfer path along which a sheet of paper P is fed is formed through the functional spaces A and B and leads to the sheet receiver 531. In the functional space A, printing operations of the ink-jet heads 1 to print images on the paper sheet P are performed. In the functional space B, the paper sheets P are supplied one after another from a sheet supply tray 523 of a sheet supply unit 501*b*. In the functional space C, four ink cartridges (main tanks) 50 are disposed as ink supply sources.

In the functional space A, there are disposed the above-described four ink-jet heads 1, a sheet transfer unit 521, and sheet guide devices for guiding the paper sheet P. In an upper part of the functional space A, there is disposed a controller 501 for controlling operations of various devices of the printer 500.

Each ink-jet head 1 has a housing in the form of a generally rectangular parallelepiped the longitudinal direction of which is parallel to the primary scanning direction. The housing 501*a* has a head frame 503 supporting the four ink-jet heads 1 such that the four ink-jet heads 1 are arranged at a predetermined pitch in the secondary scanning direction. The four ink-jet heads 1 are supplied with respective four colors of ink, namely, magenta, cyan, yellow and black inks, as described below, and are configured to eject droplets of the respective colors of ink from their lower surfaces (ink ejecting surfaces) 4*a* toward the paper sheet P. The construction of each ink-jet head 1 will be described in more detail.

The sheet transfer unit 521 includes two belt rollers 506, 507, an endless conveyor belt 508 connecting the two belt rollers 506, 507, a nip roller 504 disposed adjacent to the belt roller 506, a sheet separator plate 505 disposed adjacent to the belt roller 507, and a platen 519 disposed within the loop of the conveyor belt 508. The belt roller 507 is a drive roller rotated clockwise as seen in FIG. 1 by a belt drive motor (not shown) under the control of the controller 501. As a result of the clockwise rotation of the belt roller 507, the upper span of the conveyor belt 508 is moved rightwards as indicated by arrows in FIG. 1. The belt roller 506 is a driven roller rotated clockwise as the conveyor belt 508 is rotated by the belt roller 507. The nip roller 504 cooperates with the belt roller 506 to press the paper sheet P onto an outer surface 508*a* of the conveyor belt 508 as the paper sheet P is fed from an upstream sheet guide device (described below). The outer surface 508*a* is coated with a slightly adhesive silicone layer. The sheet separator plate 505 disposed adjacent to the belt roller 507 functions to separate the paper sheet P from the outer surface 508*a*, so that the paper sheet P is fed toward a downstream sheet guide device (described below). The platen 519 is disposed below and in opposition to the four ink-jet heads 1, and functions to support the upper span of the conveyor belt 508 on its inner surface, so that a suitable amount of gap required to permit desired image forming operations of the ink-jet heads 1 is maintained between the outer surface 508*a* and the ink ejecting surfaces 4*a* of the ink-jet heads 1.

The upstream and downstream sheet guide devices are disposed on the respective opposite sides of the sheet transfer unit 521. The upstream sheet guide device includes two guides 527*a*, 527*b*, and a pair of feed rollers 526, and functions to guide the paper sheet P from the above-indicated sheet supply unit 501*b* to the sheet transfer unit 521. The downstream sheet guide device includes two guides 529*a*, 529*b*, and a pair of feed roller 528, and functions to guide the paper sheet P from the sheet transfer unit 521 to the sheet receiver 531. One of the two feed rollers 526, and one of the two feed rollers 528 are driven by a sheet feed motor (not shown) under the control of the controller 501. The guides 527*a*, 527*b*, 529*a*, 529*b* are arranged to guide the paper sheet P to and from the pairs of rollers 526, 528.

In the functional space B, there is disposed the above-indicated sheet supply unit 501*b* such that the sheet supply unit 501*b* is removable from the housing 501*a*. The sheet supply unit 501*b* includes the above-indicated sheet supply tray 523 and a sheet supply roller 525. The sheet supply tray 23 is a box having an upper opening, and accommodates a stack of paper sheets P. The sheet supply roller 525 is driven by a sheet supply motor (not shown) under the control of the controller 501, to feed the uppermost paper sheet P of the stack toward the upstream sheet guide device.

In the functional spaces A and B, the sheet transfer path is formed so as to extend from the sheet supply unit 501*b* to the sheet receiver 531 through the sheet transfer unit 521. The sheet supply motor, sheet feed motor and belt drive motor described above are driven under the control of the controller 501 according to printing control commands, so that the uppermost paper sheet P is fed by the sheet supply roller 525 from the sheet supply tray 523, fed by the feed rollers 526 to the sheet transfer unit 521, and fed by the conveyor belt 508 under the ink ejecting surfaces 4*a* of the ink-jet heads 1 in the secondary scanning direction while the ink droplets are ejected from the ink ejecting surfaces 4*a*, whereby the desired color images are printed on the paper sheet P. Subsequently, the paper sheet P is separated by the sheet separator plate 505 from the outer surface 508*a* of the conveyor belt 508, and is fed upwards by the pair of feed rollers 528 while the paper sheet P is guided by the guides 529*a*, 529*b*, and is ejected onto the sheet receiver 531.

The secondary scanning direction is a horizontal direction parallel to the direction of feeding of the paper sheet p by the sheet transfer unit 521, while the primary scanning direction is a horizontal direction perpendicular to the secondary scanning direction.

In the functional space C, there is disposed an ink unit 501*c* such that the ink unit 501*c* is removable from the housing 501*a*. The ink unit 501*c* includes a tank tray 535, and the above-indicated four main tanks (ink cartridges) 50, which are respectively used for the four ink-jet heads 1 and are arranged in the tank tray 535 in the secondary scanning direction. The ink is supplied from each of the main tanks 50 through a tube to the corresponding ink-jet head 1.

Figure 2:
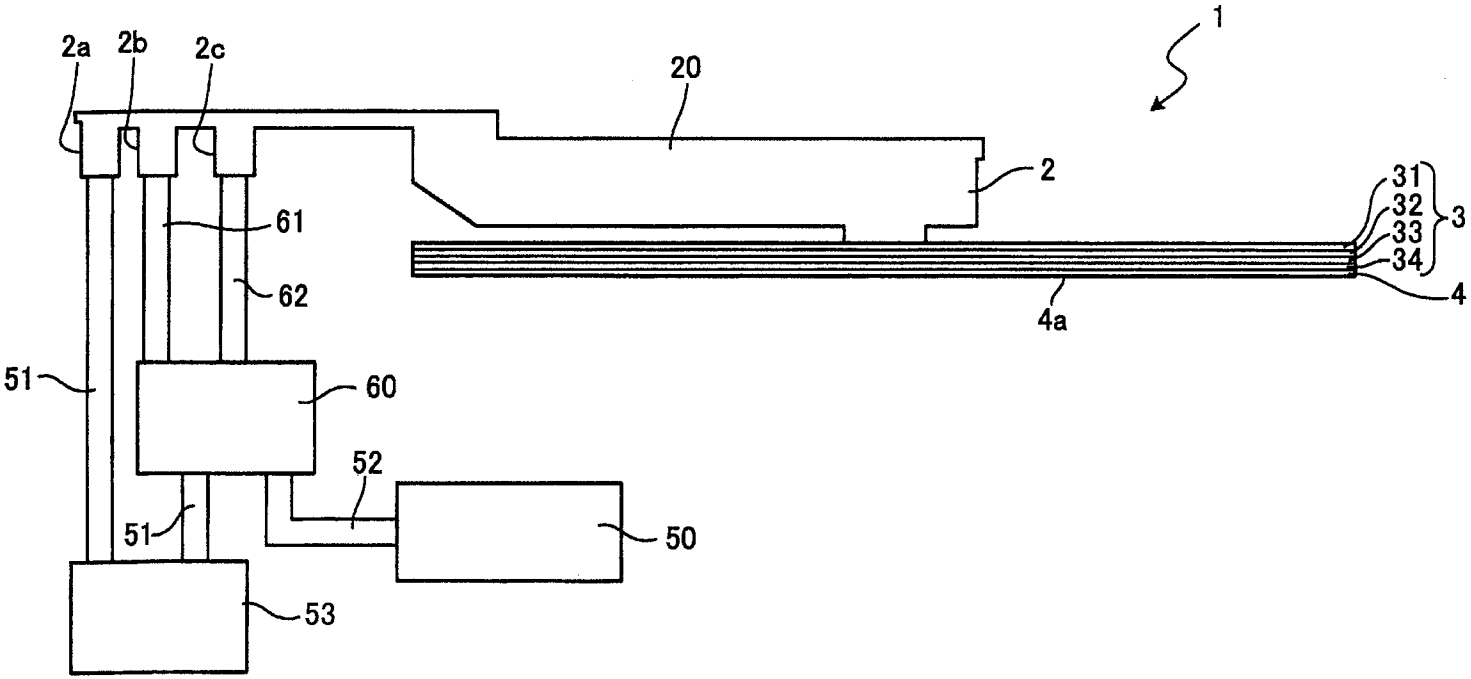
FIG. 2 is a side elevational view of the ink-jet head of FIG. 1.
Figure 3B:
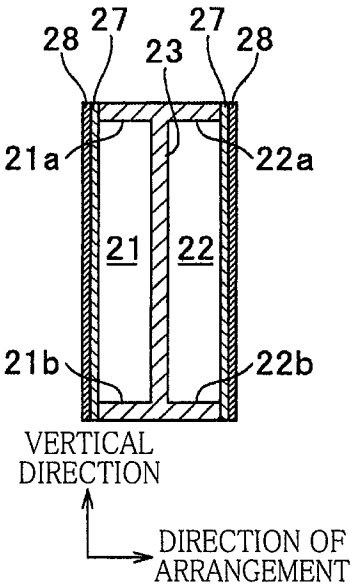
FIG. 3B is a cross sectional view taken along line B-B of FIG. 3A.
Figure 3A:
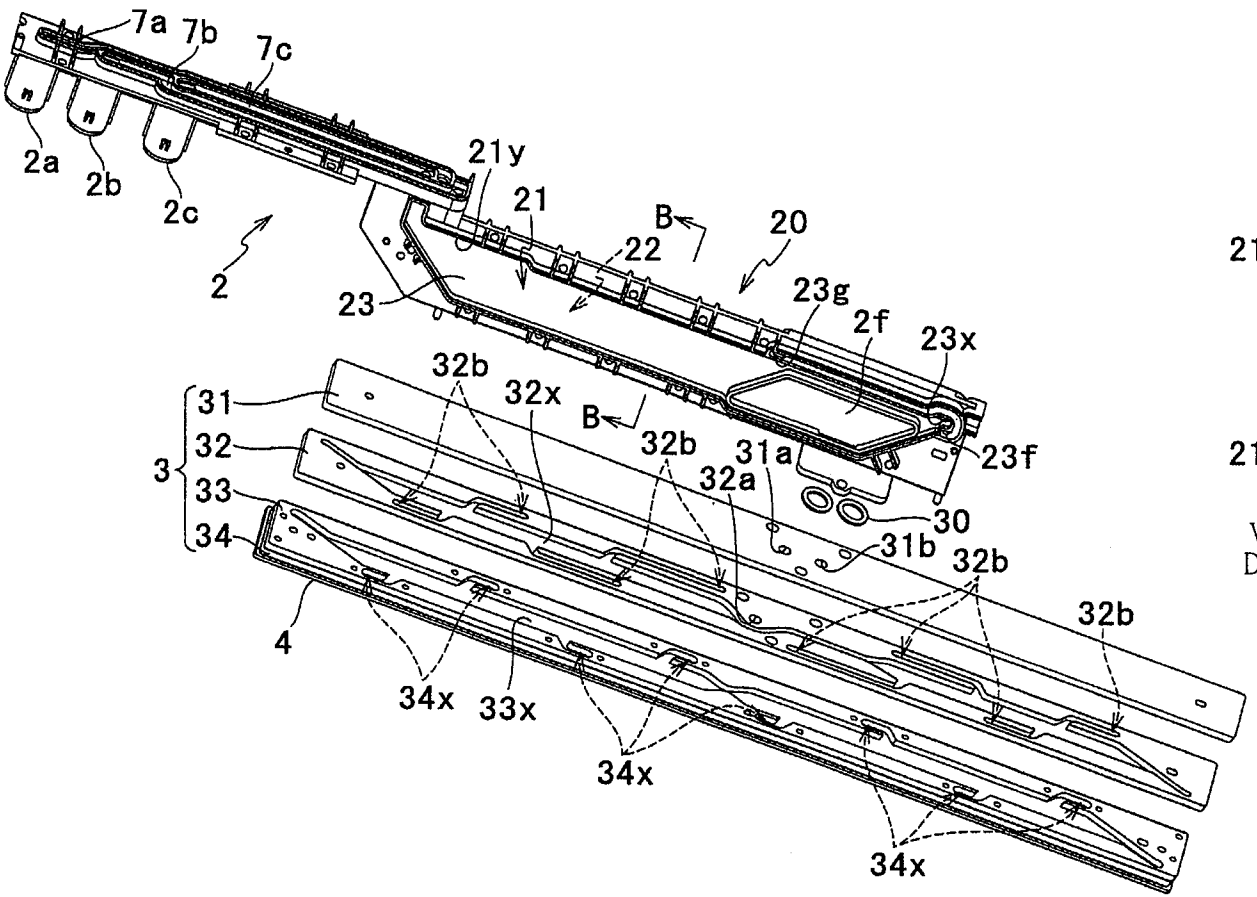
FIG. 3A is an exploded perspective of the ink-jet head of FIG. 1.
Figure 4:
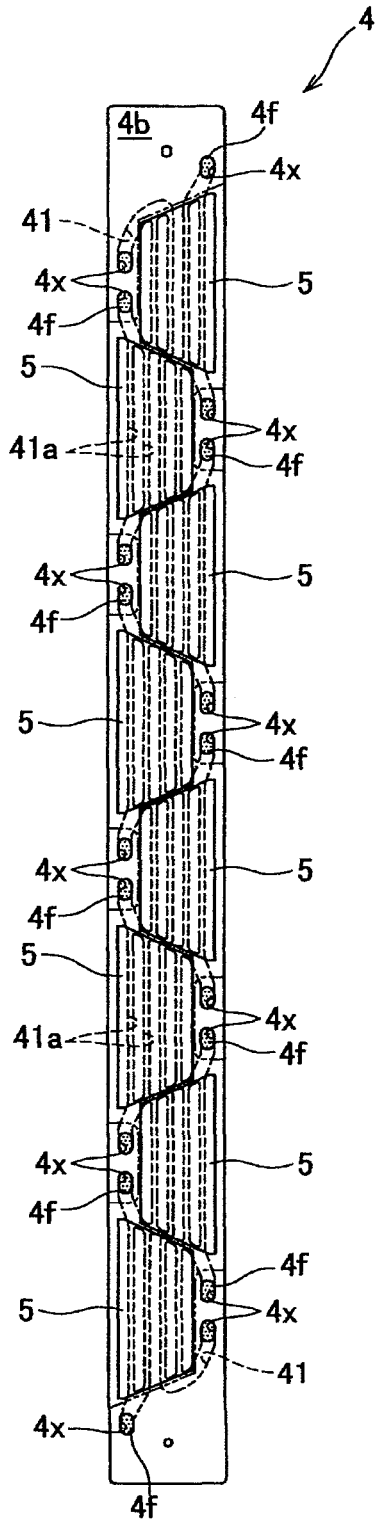
FIG. 4 is a plan view of a passage unit of the ink-jet head of FIG. 1.

Referring nest to FIGS. 2-4, the construction of each ink-jet head 1 will be described. As shown in FIG. 2, the ink-jet head 1 includes a filter unit 2, a reservoir unit 3 and a passage unit 4, which are arranged in the order of description in the downward direction.

The filter unit 2 is a one-piece structure formed of a suitable material such as a synthetic resin, consisting of two planar portions connected together at their one ends so as to extend in one direction such that the planes of the two planar portions are perpendicular to each other, that is, parallel to the respective vertical and horizontal directions. One of the two planar portions is a base portion 20 provided with a first filter in the form of a filter 2*f*, while the other planar portion is a connector portion having three joints 2*a*, 2*b* and 2*c* in the form of sleeves, as shown in FIG. 3A. The joints 2*a*, 2*b* and 2*c* are disposed at one of the opposite longitudinal end portions of the connector portion, which is remote from the base portion 20. The joints 2*a*-2*c* extend downwards, for connection with respective elastic tubes 51, 61 and 62. As shown in FIG. 2, the filter unit 2 is connected to a pump 53 and an auxiliary tank 60 through the joints 2*a*-2*c* and elastic tubes 51, 61, 62. The pump 53 is connected to an intermediate portion of the elastic tube 51.

The main and auxiliary tanks 50, 60 serve as a liquid supply source, which store an ink of a color corresponding to the ink-jet head 1, and are held in communication with each other through an elastic tube 52. The main tanks (ink cartridges) 50 are removably installed in the housing 501*a* of the printer 500, as shown in FIG. 1, and supply the auxiliary tank 60 with the ink, as needed. The auxiliary tank 60 has a hole (not shown) open to the atmosphere, through which air bubbles contained in the ink are released into the atmosphere. The auxiliary tank 60 is disposed at a suitable position within the housing 501*a*. The pump 53, and valves connected to the elastic tubes 51, 61, 62 are controlled by the controller 501 (shown in FIG. 1) during a printing operation or purging operations of the ink-jet head 1, as described below in detail. During the printing operation, the ink is supplied from the auxiliary tank 62 to the filter unit 2 through the elastic tube 62, and then fed forwards to ink-ejecting nozzles (not shown) of the passage unit 4 through a forward ink passage system described below. During the purging operations, the pump 53 is operated to supply the ink from the auxiliary tank 60 to the filter unit 2 through the tube 51, for feeding the ink through the ink-jet head 1 through a forward ink passage system, and the ink is returned back to the auxiliary tank 60 through the tube 61 or 62, through a return ink passage system.

The construction of the filter unit 2 and flows of the ink during the printing and purging operations of the ink-jet head 1 will be described below in detail.

The reservoir unit 3 is a laminar passage-forming structure consisting of four rectangular metal plates 31, 32, 33 and 34 which have the same surface area as seen in the horizontal plane and which are bonded together. As shown in FIG. 3A, the reservoir unit 3 is fluid-tightly fixed to the filter unit 2 through two O-rings 30 formed of a rubber or other elastic material, and by means of suitable fixing means.

As also shown in FIG. 3A, each of the metal plates 31-34 of the reservoir unit 3 has through-holes and recesses for forming ink passages in the reservoir unit 3. Described more specifically, the uppermost metal plate 31 has two through-holes 31*a* and 31*b*, and the second metal plate 32 has a through-hole 32*a* communicating with the through-hole 31*a*, a recess 32*x* communicating with the through-hole 31*b*, and through-holes 32*b* formed in an end portion of each of branch grooves of the recess 32*x*. The through-hole 32*a* is held in communication with a reservoir 33*x* (described below), and the recess 32*x* is formed in the upper surface of the metal plate 32, so as to extend in the longitudinal direction of the ink-jet head 1, so that the ink containing the foreign matters flows through the recess 32*x* during an inter-filter purging operation of the ink-jet head 1, which will be described by reference to FIG. 8. The through-holes 32*b* respectively communicate with the end portions of branch passages of the reservoir 33*x*. The third metal plate 33 has the above-indicated reservoir 33*x*, which temporarily stores the ink. The reservoir 33*x* is formed through the thickness of the third metal plate 33, so as to extend in the longitudinal direction of the ink-jet head 1. The end portions of the branch passages of the reservoir 33*x* are held in communication with the through-holes 32*b* formed in the end portions of the branch grooves of the recess 32 in the second metal plate 32 superposed on the third metal plate 33, and are aligned with respective through-holes 4*x* (shown in FIG. 4) formed through the passage unit 4 located below the third metal plate 33. The reservoir 33*x* are closed at its upper opening by the lower surface of the second metal plate 32, and at its lower opening by the upper surface of the fourth metal plate 34, except in the end portions of the branch passages of the reservoir 33*x*. The fourth metal plate 34 has through-holes 34*x* in communication with the above-indicated through-holes 4*x* formed through the passage unit 4, and with the end portions of the branch passages of the reservoir 33*x*.

As described above, the reservoir unit 32 has two ink passage systems. During the printing operation (described below by reference to FIG. 5) and a nozzle purging operation (described below by reference to FIGS. 6A-6C) of the ink-jet head 1, the ink flows through one of the ink passage systems, that is, the ink flows from the filter unit 2 through the through-holes 31*a*, 32*a* into the reservoir 33*x*, more specifically, into the branch passages of the reservoir 33*x*, and flows into the through-holes 4*x* of the passage unit 4 through the through-holes 34*x*. During the inter-filter purging operation (described by reference to FIGS. 8A-8C) of the ink-jet head 1, the ink flows through the other ink passage system, that is, the ink fed into the reservoir 33*x* through the through-hole 32*a* flows from the branch passages of the reservoir 33*x* into the recess 32*x* through the through-holes 32*b*, and then into the filter unit 2 through the through-hole 31*b*.

As shown in FIG. 4, the passage unit 4 has eight piezoelectric actuator units 5 each having a trapezoidal shape, which are arranged in two rows in a zigzag fashion on its upper surface 4*b*. The through-holes 4*x* described above are formed in surface areas of the passage unit 4 outside the surface areas of the actuator units 5. In the surface areas of a lower surface 4*a* (shown in FIG. 2) of the passage unit 4 which correspond to the respective surface areas of the actuator unit 5, a multiplicity of ink ejecting nozzles (not shown) serving as liquid-droplet ejecting nozzles are open for ejecting the ink droplets. The passage unit 4 has main manifold passages 41 in communication with the through-holes 4*x*, auxiliary manifold passages 41*a* in communication with the main manifold passages 41, and individual ink passages for communication between the auxiliary manifold passages 41*a* and the ink-ejecting nozzles. As shown in FIG. 4, the main manifold passages 41 are held in communication with the through-holes 4*x*.

The lower surface of the lowermost metal plate 34 of the reservoir unit 3 has recessed and raised portions The recessed portions cooperate with the upper surface 4*b* to define spaces in which the respective actuator units 5 are fixed to the upper surface 4*b*. The lower surface of the metal plate 34 cooperates with a flexible printed circuit FPC) covering the actuator units 5, to define a small amount of gap. The through-holes 34*x* in communication with the reservoir 33*x* are formed through the raised portions formed on the lower surface of the metal plate 34, such that the through-holes 34*x* are open in the top surfaces of the raised portions. The lower surface of the metal plate 34 is bonded at these top surfaces to the upper surface 4*b* of the passage unit 4.

Referring to FIGS. 3A and 3B and FIGS. 5A-5C, the construction of the filter unit 2 will be described in detail.

As shown in FIG. 3A, a connecting portion of the filter unit 2 has three connecting passages 7*a*, 7*b* and 7*c* connecting the joints 2*a*-2*c* to first and second chambers 21 and 22 provided in the base portion 20. The connecting passage 7*a* connects the joint 2*a* to the second chamber 22 of the base portion 20, and the connecting passage 7*c* connects the joint 2*c* to the first chamber 21 of the base portion 20, while the connecting passage 7*b* connects the joint 2*b* to the through-hole 31*b* formed through the metal plate 31. The base portion 20 includes a fixing portion on a lower surface of its longitudinal end portion remote from the above-indicated connecting portion. At this fixing portion, the filter unit 2 is fixed to the reservoir unit 3. The fixing portion is parallel with the connecting portion, and is provided with the above-described two O-rings 30 and a fixing member (not shown). Two through-holes 24 and 25 are formed through the fixing portion, as shown in FIG. 5B. The upper walls of the connecting passages 7*a*-7*c* are laminar structures similar to a laminar structure consisting of a flexible film 27 and a metal sheet 28 (which will be described by reference to FIG. 3B). Namely, each of the connecting passages 7*a*-7*c* is fluid-tightly sealed at its upper opening by the flexible film backed by the metal sheet.

The base portion 20 has an interior space which is divided into the above-indicated first and second chambers 21, 22 by a partition wall 23 that extends in the vertical direction, with the ink-jet head 1 installed in the printer 500 such that the lower surface 4*a* of the passage unit 4 extends in the horizontal direction. As indicated in FIG. 3B, the first and second chambers 21, 22 are arranged in the horizontal direction on the respective opposite sides of the partition wall 23. Each of the first and second chambers 21, 22 has a rectangular shape in cross section taken in a vertical plane parallel to the vertical direction of extension of the partition wall 23 and the direction of arrangement of the chambers 21, 22, as indicated in FIG. 3B. The rectangle of this cross sectional shape has a larger dimension in the vertical direction than that in the horizontal direction. One of the opposite long sides of the rectangle is defined by the partition wall 23 while the other long side is defined by the laminar structure of the flexible film 27 and metal sheet 28. The metal sheet 28 functions to prevent an excessive amount of outward flexure of the flexible film 27 and direct exertion of an external force onto the flexible film 27. It is noted that the flexible film 27 and metal sheet 28 are not shown in FIG. 3A.

The first and second chambers 21, 22 are held in communication with each other through a communication passage 23*x* which is formed through the partition wall 23 and which is a through-hole having a substantially circular cross sectional shape, as shown in FIG. 3A. The communication passage 23*x* is formed through an upper end portion of the partition wall 23 and at one of longitudinally opposite ends of the partition wall 23 which is remote from the joints 2*a*-2*c* in the horizontal direction perpendicular to the vertical direction of extension of the partition wall 23 and the direction of arrangement of the two chambers 21, 22.

Figure 5A:
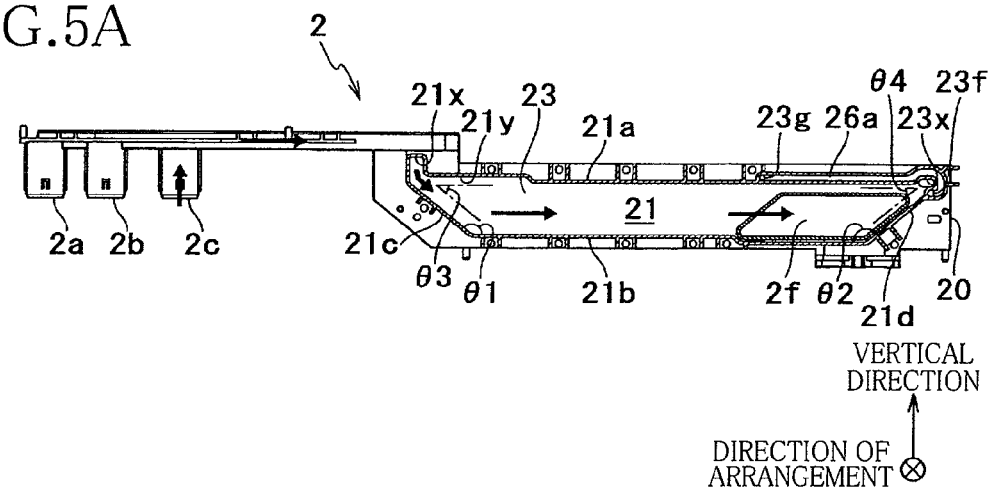
Figure 5B:
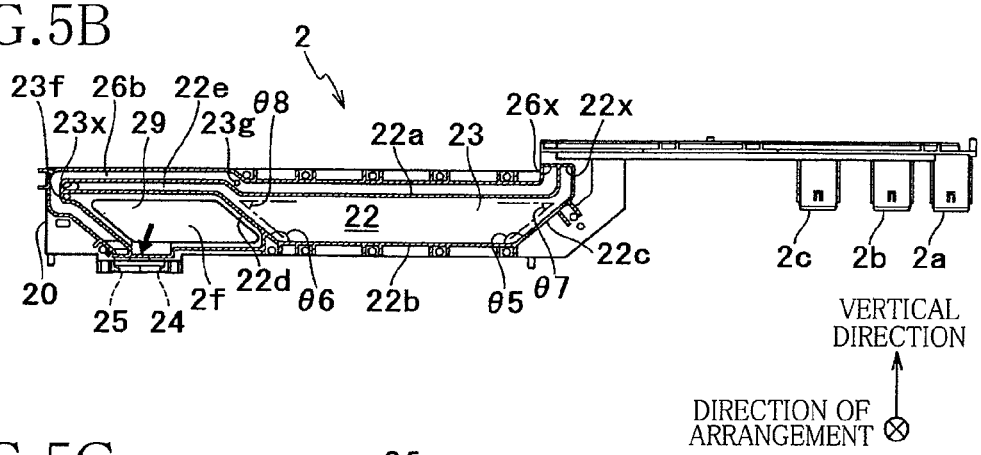

As shown in FIG. 5A, the first chamber 21 is partially defined by an upper wall 21*a* and a lower wall 21*b* both extending in the horizontal direction, and two end walls 21*c* and 21*d* which are inclined with respect to the vertical direction. The first chamber 21 has an inverted trapezoidal cross sectional shape as seen in the direction of arrangement of the two chambers 21, 22, as shown in FIG. 5A. An exhaust passage 26*a* is formed as a bypass passage, so as to surround the opening of the communication passage 23*a* on the side of the first chamber 21. The exhaust passage 26*a*, which is defined by the filter unit 2, is isolated from the first chamber 21 by a partition wall. The laminar structure of the flexible film 27 and metal sheet 28 (shown in FIG. 3B) is disposed in opposition to the partition wall 23 in the direction of arrangement of the two chambers 21, 22. The flexible film 27 of the laminar structure is fixed to the end faces of the walls 21*a*-21*d* partially defining the first chamber 21 and the end face of the side wall partially defining the exhaust passage 26*a*, such that the flexible film 27 partially defines the first chamber 21 and exhaust passage 26*a*.

The exhaust passage 26*a* is held in communication at its one end with an upper end portion of a filter chamber 29 (described below) through a through-hole 23*f*, and at the other end with an exhaust passage 26*b* (described below) through a through-hole 23*g*. The air bubbles accumulated in the upper portion of the filter chamber 29 are exhausted through the exhaust passage 26*a*.

As shown in FIG. 5B, the second chamber 22 is partially defined by an upper wall 22*a* and a lower wall 22*b* both extending in the horizontal direction, and two end walls 22*c* and 22*d* which are inclined with respect to the vertical direction. The second chamber 22 includes a main space having an inverted trapezoidal cross sectional shape as seen in the direction of arrangement of the two chambers 21, 22, as shown in FIG. 5B, and further includes a passage 22*e* communicating with the main space. The passage 22*e* extends from an upper corner part of the main space adjacent to the upper portion of the end wall 22*d*, in the longitudinal direction of the base portion 20, and is located at a vertical position higher than that of the main space, as seen in the vertical direction. Below the passage 22*e*, there is formed the above-indicated filter chamber 29, with a partition wall existing between the passage 22*e* and the filter chamber 29. The filter chamber 29 is partially defined by the above-indicated partition wall partially defining the passage 22*e*, and by the end wall 22*d* partially defining the second chamber 22. The filter chamber 29 is further partially defined by a lower wall parallel to the partition wall partially defining the passage 22*e*, and by an end wall parallel to the end wall 22*d*. The filter chamber 29 has a parallelogram cross sectional shape as seen in the direction of arrangement of the two chambers 21, 22, as shown in FIG. 5B. This parallelogram has horizontally extending opposite parallel long sides. The shape of the filter chamber 29 is substantially identical with the shape of the filter 2*f*, and the size of the filter chamber 29 is larger than that of the filter 2*f*. The above-indicated exhaust passage 26*b* is formed so as to surround the second chamber 22 and the filter chamber 29. Namely, the exhaust passage 26*b* is partially defined by the upper wall 22*a*, and the inclined end wall which partially defines the filter chamber 29 and which is parallel and opposed to the end wall 22*d*. The laminar structure of the flexible film 27 and metal sheet 28 (shown in FIG. 3B) partially defining the second chamber 22 is also disposed in opposition to the partition wall 23 in the direction of arrangement of the two chambers 21, 22. The flexible film 27 of the laminar structure is fixed to the end faces of the walls 22*a*-22*d* partially defining the second chamber 22 and the end faces of the side walls partially defining the filter chamber 29 and exhaust passage 26*b*, such that the flexible film 27 partially defines the second chamber 22, filter chamber 29 and exhaust passage 26*b*. The exhaust passage 26*b* is provided to discharge the ink fed from the reservoir 33*x* and exhaust passage 36*a*, out of the ink-jet head 1, into the auxiliary tank 60, for example.

Regarding the first chamber 21 shown in FIG. 5A, an angle of inclination θ1 of the end wall 21*c* with respect to the lower wall 21*b*, and an angle of inclination θ2 of the end wall 21*d* with respect to the lower wall 21*b* are both obtuse angles (e.g. about 140 degrees), while an angle of inclination θ3 of the end wall 21*c* with respect to the upper wall 21*a*, and an angle of inclination θ4 of the end wall 21*d* with respect to the upper wall 21*a* are both are both acute angles (e.g. about 40 degrees). Regarding the second chamber 22 shown in FIG. 5B, an angle of inclination θ5 of the end wall 22*c* with respect to the lower wall 22*b*, and an angle of inclination θ6 of the end wall 22*d* with respect to the lower wall 22*b* are both obtuse angles (e.g. about 140 degrees), while an angle of inclination θ7 of the end wall 22*c* with respect to the upper wall 22*a*, and an angle of inclination θ8 of the end wall 22*d* with respect to the upper wall 22*a* are both acute angles (e.g. about 40 degrees).

The obtuse angles of inclination θ1, θ2, θ5, θ6 of the end walls 21*c*, 21*d*, 22*c*, 22*d* with respect to the lower walls 21*b*, 22*b* permit smooth substantially horizontal flows of the ink through the first and second chambers 21, 22 in the longitudinal direction, without dwelling of the ink in the lower corner portions of the chambers 21, 22, and also permit smooth substantially horizontal flows of the air bubbles together with the ink, without dwelling of the air bubbles within the chambers 21, 22.

The first chamber 21 has an inlet opening 21*x* formed at its longitudinal end which is nearer to the joints 2*a*-2*c* (in the connecting portion of the filter unit 2), that is, remote from the communication passage 23*x*, as shown in FIG. 5A. Through this inlet opening 21*x*, the first chamber 21 is held in communication with the connecting passage 7*c* (shown in FIG. 3A). The upper wall 21*a* provides a recessed portion 21*y* within the first chamber 21, as also shown in FIG. 5A. The recessed portion 21*y* is defined by a part of the lower surface of the upper wall 21*a*, which part is adjacent to the inlet opening 21*x* and slightly offset in the upward direction from the other part of the above-indicated lower surface. The recessed portion 21*y* is formed so as to extend from the inlet opening 21*x* in the horizontal direction within the first chamber 21. The recessed portion 21*y* functions to temporarily capture the air bubbles contained in the ink which has entered into the first chamber 21 through the inlet opening 21*x*, so that the air bubbles are prevented from flowing toward the filter 2*f*.

The above-indicated main space of the second chamber 22 has an inlet opening 22*x* formed at its longitudinal end which is nearer to the joints 2*a*-2*c* (in the connecting portion of the filter unit 2), that is, remote from the communication passage 23*x*, as shown in FIG. 5B. Through this inlet opening 22*x*, the main space is held in communication with the connecting passage 7*a* (shown in FIG. 3A). As also shown in FIG. 5B, the main space of the second chamber 22 is held in communication with the above-indicated passage 22*e*, at its upper end and at its longitudinal end remote from the inlet opening 22*x*. At the end of the passage 22*e* remote from the main space, the passage 22*e* is held in communication with the communication passage 23*x*.

Figure 5C:
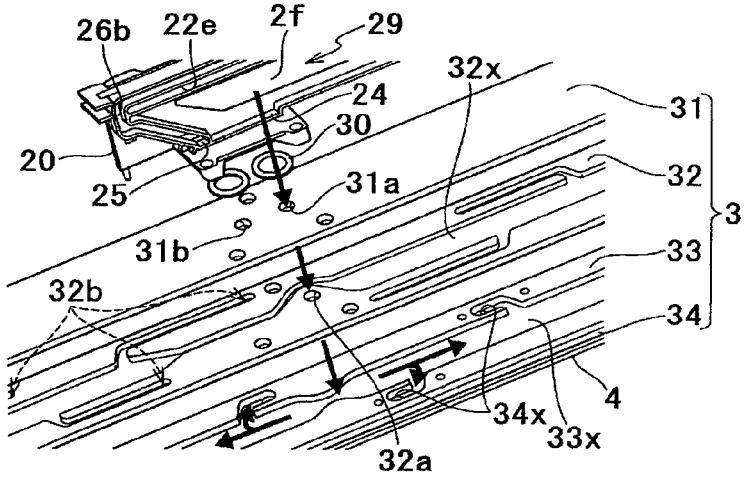

The partition wall 23 which partially defines the filter chamber 29 has an opening formed therethrough, at which the filter 2*f* is disposed in the filter chamber 29 such that the filter 2*f* is fixed at its peripheral portion to a portion of the partition wall 23 which defines the opening. The filter 2*f* is a meshed planar member configured to capture the foreign matters in the ink, and is fixed so as to extend in the vertical direction parallel to the surfaces of the partition wall 23. Thus, it will be understood that the first chamber 21 and the filter chamber 29 cooperate to define a filter accommodating space in which the filter 2*f* is disposed, and are held in communication with each other through the mesh of the planar filter 2*f*. The filter accommodating space is divided by the partition wall 23 into the first chamber 21 serving as an upstream portion, and the filter chamber 29 serving as a downstream portion. The filter chamber 29 is held in communication with the through-hole 31*a* of the reservoir unit 3 through the above-described through-hole 24 formed through the above-described fixing portion (lower wall) of the base portion 20, as shown in FIG. 5C.

In the filter chamber 29, the filter 2*f* is positioned to be nearer to the lower wall 21*b* than to the upper wall 21*a*, in the vertical direction, so that an upper gap between the upper end of the filter 2*f* and the upper wall 21*a* is larger than a lower gap between the lower end of the filter 2*f* and the lower wall 21*b*. The larger upper gap prevents the filter 2*f* to capture and hold the air bubbles which have entered into the first chamber 21. The communication passage 23*x* is located between the upper wall 21*a* and the filter 2*f* in the vertical direction, and is lightly spaced from the filter 2*f* in the longitudinal direction of the base portion 20 away from the inlet openings 21*x*, 22*x*.

The exhaust passage 26*b* has an opening 26*x* at its end nearer to the connecting end (nearer to the joints 2*a*-2*c*). Through this opening 26*x*, the exhaust passage 26*b* is held in communication with the connecting passage 7*b* (FIG. 3A). The base portion 20 has the above-described through-hole 25 through which the exhaust passage 26*b* is held in communication with the through-hole 31*b* of the reservoir unit 3.

The partition wall 23 which has the opening at which the filter 2*f* is fixed at its periphery, and the communication passage 23*x*, further has a through-hole 23*f* formed at an upper corner of the filter chamber 29, and a through-hole 23*g* communicating with the exhaust passage 26*b*. The filter chamber 29 is held in communication with the exhaust passage 26*a* through the through-hole 23*f*, while the exhaust passage 26*a* is held in communication with the exhaust passage 26*b* through the through-hole 23*g*.

Referring to FIGS. 5A-5C, the ink flows during the printing operation of the inkjet head 1 will be described.

During the printing operation of the ink-jet head 1, the valve connected to the elastic tube 62 connecting the inlet join 2*c* and the auxiliary tank 60 is opened, and the ink is delivered from the auxiliary tank 60 (FIG. 2) into the filter unit 2 through the joint 2*c* and connecting passage 7*c*, as indicated by arrows in FIG. 5A. At this time, the pump 53 is held at rest, while the valve connected to the elastic tube 51 connecting the joint 2*a* and the pump 53 and the valve connected to the elastic tube 61 connecting the joint 2*b* and the auxiliary tank 60 are both held in the closed state. Described in detail, the ink flows from the joint 2*c* into the first chamber 21 through the connecting passage 7*c* (FIG. 3A) and the inlet opening 21*x*, and then flows through the first chamber 21 toward the filter 2*f*, as shown in FIG. 5A. The ink then flows from the first chamber 21 into the fitter chamber 29 through the filter 2*f*, as shown in FIG. 5B, and enters into the reservoir unit 3 through the through-hole 24 (formed through the fixing portion of the base portion 20) and the through-hole 31*a*, as shown in FIG. 5C. The ink which has flown into the reservoir unit 3 through the through-hole 31*a* flows into the reservoir 33*x* through the through-hole 32*a*, and into the individual branch passages of the reservoir 33*x*. Subsequently, the ink flows into the passage unit 4 through the through-holes 34*x* and through-holes 4*x* (FIG. 4). The ink which has entered into the passage unit 4 through the through-holes 4*x* is distributed into the individual ink passages through the main manifold passages 41 and auxiliary manifold massages 41*a*, and is ejected from selected ones of the ink-ejecting nozzles according to the operations of the actuator units 5 as well known in the art. The consumption of the ink due to the ink ejections from the ink-ejecting nozzles during the printing operation causes an increase of the negative pressure at the meniscus of each ink-ejecting nozzle, and induces an ink flow from the auxiliary manifold passage 41*a* toward the ink-ejecting nozzle. Thus, the flows of the ink are naturally caused as the ink is consumed during the printing operation of the ink-jet head 1 to form the images on the paper sheets P.

As shown in FIG. 4, the through-holes 4*x* formed in the passage unit 4 are covered by respective second filters in the form of filters 4*f*. That is, the through-holes 34*x* and the through-holes 4*x* are held in communication with each other through these filters, so that the ink flows from the reservoir unit 3 into the passage unit 4 through the filters 4*f*.

Figure 6A:
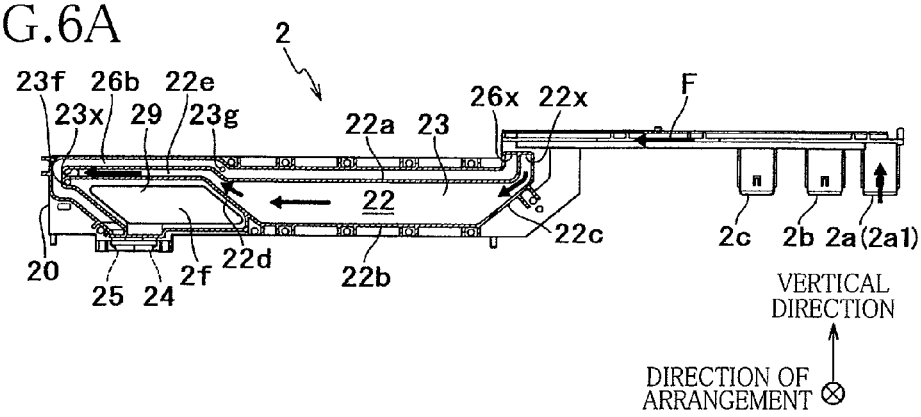
Figure 6B:
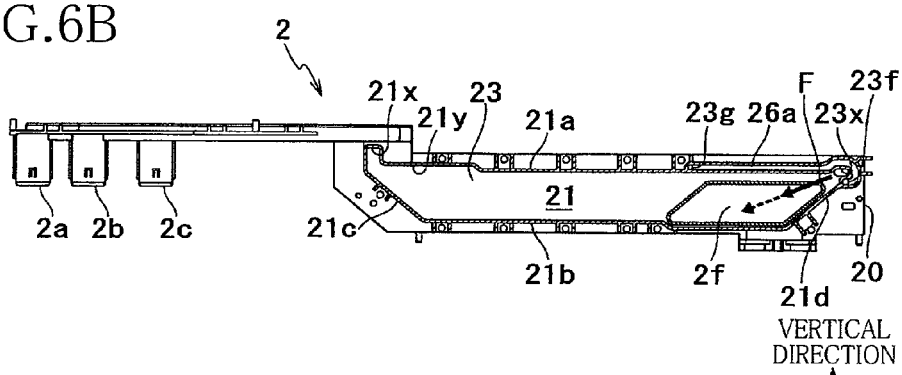
Figure 6C:
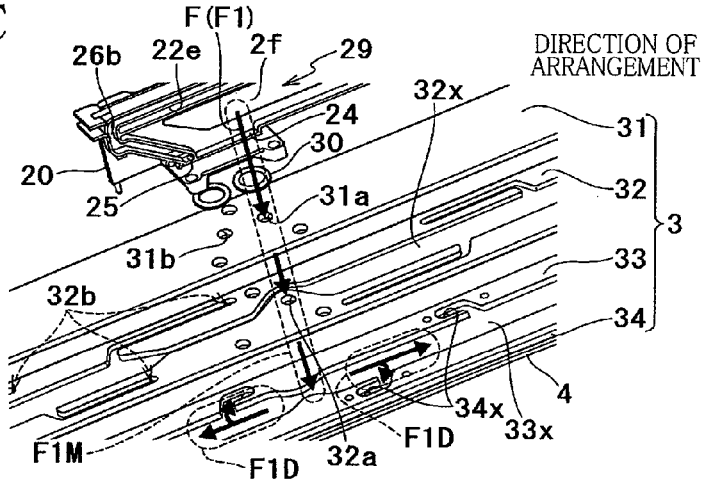

Referring next to FIGS. 6A-6C, the ink flows during the nozzle purging operation of the ink-jet head 1 will be described. The nozzle purging operation is performed to forcibly introduce the ink into the passage unit 4 and eject the ink from the ink-ejecting nozzles, for the purpose of eliminating or preventing plugging of the nozzles with the ink. In other words, the nozzle purging operation is performed to discharge the ink having a relatively high degree of viscosity, from the nozzles, for thereby recovering the ink ejecting performance of the nozzles.

During the nozzle purging operation of the ink-jet head 1, the valve connected to the elastic tube 51 connecting the joint 2*a* and the pump 53 is opened, and the ink is delivered from the auxiliary tank 60 (FIG. 2) into the filter unit 2 through the joint 2*a* and connecting passage 7*a*, by an operation of the pump 53, as indicated by thick solid-line arrows in FIG. 6A. At this time, the valves connected to the elastic tubes 61, 62 respectively connecting the joints 2*b*, 2*c* to the auxiliary tank 60 are both held in the closed state. Described in detail, the ink flows from the joint 2*a* into the main space of the second chamber 22 through the connecting passage 7*a* (FIG. 3A) and the inlet opening 22*x*, and then flows through the main space and the passage 22*e*. Then, the ink flows from the passage 22*e* into the first chamber 21 through the communication passage 23*x*, as shown in FIG. 6B. The ink which has entered into the first chamber 21 through the communication passage 23*x* flows into the filter chamber 29 through the filter 2*f*, and then into the reservoir unit 3 through the through-hole 24 and through-hole 31*a*, as shown in FIG. 6C. The ink then flows from the reservoir unit 3 into the passage unit 4, and is ejected from the nozzles, as described above with respect to the printing operation of the ink-jet head 1.

The passages through which the ink flows during the nozzle purging operation from an inlet opening in the form of an opening 2*a*1 of the joint 2*a* to the ink-ejecting nozzles open in the lower surface of the passage unit 4, will be collectively referred to as a forward passage system F indicated by thick solid-line arrows in FIGS. 6A-6C. The forward passage system F is defined by the filer unit 2, reservoir unit 3 and passage unit 4. In this forward passage system F, the filter 2*f* and the filters 4*f* (FIG. 4) are disposed in series with each other, at respective upstream and downstream positions as seen in the direction of flow of the ink indicated by the thick solid-line arrows in FIGS. 6A-6C.

Figure 7A:
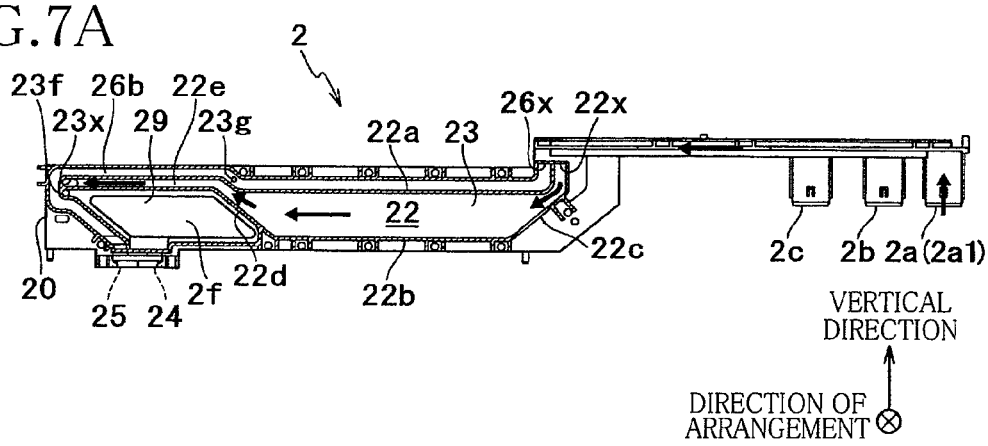
Figure 7B:
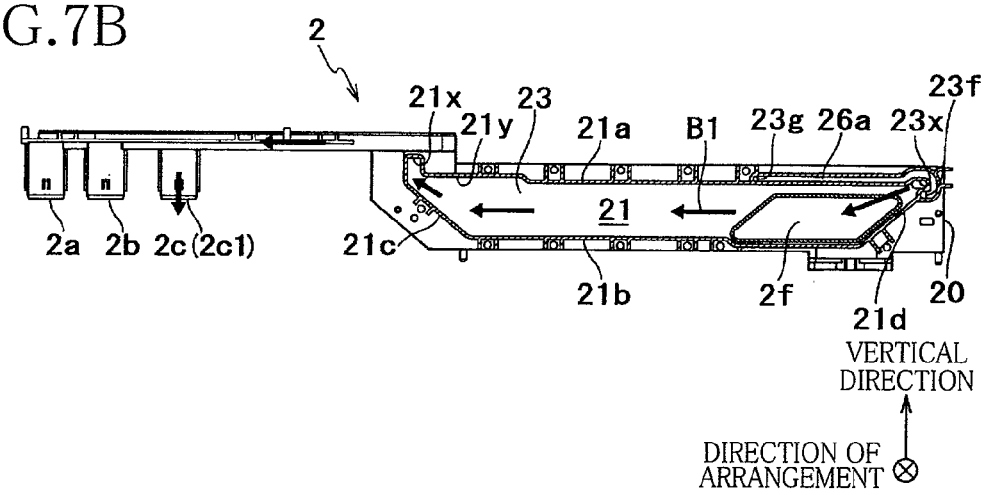

Referring next to FIGS. 7A and 7B, the ink flows during the circulation purging operation of the ink-jet head 1 will be described. The circulation purging operation is performed to forcibly introduce the ink into the filter unit 2 and remove the foreign matters deposited on the filter 2*f*, together with the ink, for the purpose of eliminating or preventing clogging of the filter 2*f* with the foreign matters. In other words, the circulation purging operation is performed to effectively discharge, out of the ink-jet head 1, air bubbles and other foreign matters accumulated in a portion of the filter unit 2 upstream of the filter 2*f*.

During the circulation purging operation of the ink-jet head 1, the valve connected to the elastic tube 51 connecting the joint 2*a* and the pump 53 is opened, and the ink is delivered from the auxiliary tank 60 (FIG. 2) into the filter unit 2 through the joint 2*a* and connecting passage 7*a*, that is, into the second chamber 22, by an operation of the pump 43, as indicated by thick solid-line arrows in FIG. 7A, and as described above with respect to the nozzle purging operation by reference to FIG. 6A. At this time, the valve connected to the elastic tube 61 connecting the joint 2*b* and the auxiliary tank 60 is held in the closed state while the valve connected to the elastic tube 62 connecting the joint 2*c* and the auxiliary tank 60 is held in the open state. The ink which has been delivered into the second chamber 22 flows into the first chamber 21 through the passage 22*e* and communication passage 23*x*, as in the nozzle purging operation. Then, the ink flows along the surface of the filter 2*f* to the inlet opening 21*x*, as indicated by the thick solid-line arrows in FIG. 7B. The ink then flows through the inlet opening 21*x* and connecting passage 7*c* (FIG. 3A) into the auxiliary tank 60 through the inlet opening 2*c*.

The passages through which the ink flows during the circulation purging operation from the surface of the filter 2*f* (from one of the opposite surfaces of the filter 2*f* which is exposed to the first chamber 21 and on the upstream side as seen in the direction of flow of the ink through the forward passage system F indicated in FIGS. 6A and 6B) to a first outlet opening in the form of an opening 2*c*1 of the joint 2*c*, will be collectively referred to as a first return passage system B1, as indicated by thick solid-line arrows in FIG. 7B. The first return passage system B1 is defined by the filter unit 2.

Then, the ink flows during the inter-filter purging operation of the ink-jet head 1 will be described by reference to FIGS. 8A-8C. The inter-filter purging operation is performed to forcibly introduce the ink into the filter unit 2 and reservoir unit 3, for the purpose of removing the foreign matters accumulated in the passages between the filter 2*f* of the filter unit 2 and the filters 4*f* covering the through-holes 4*x* open in the upper surface 4*b* (FIG. 4) of the passage unit 4, such that the foreign matters are discharged together with the ink from the ink-jet head 1.

Figure 8A:
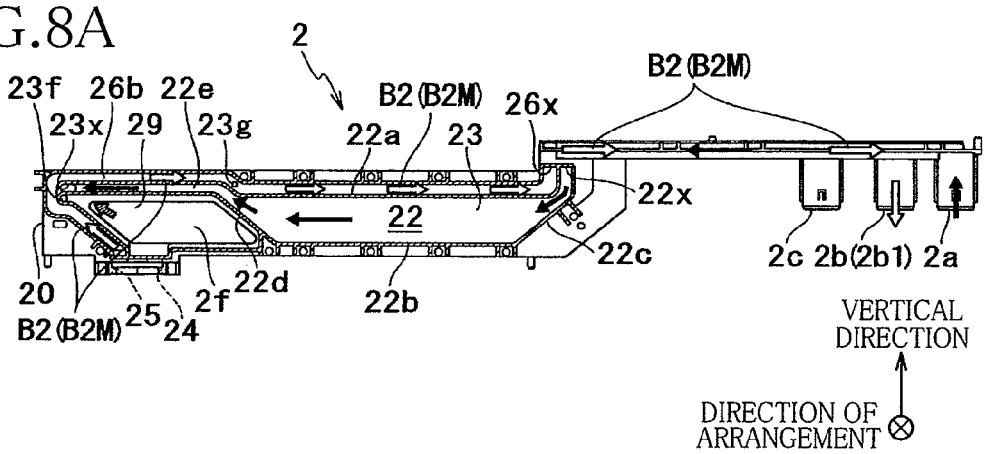

During the inter-filter purging operation of the ink-jet head 1, the valve connected to the elastic tube 51 connecting the joint 2*a* and the pump 53 is opened, and the ink is delivered from the auxiliary tank 60 (FIG. 2) into the second chamber 22 of the filter unit 2 through the joint 2*a* and connecting passage 7*a*, by an operation of the pump 53, as indicated by thick solid-line arrows in FIG. 8A, and as described above with respect to the nozzle purging operation by reference to FIG. 6A. At this time, the valve connected to the elastic tube 62 connecting the joint 2*c* and the auxiliary tank 60 is held in the closed state while the valve connected to the elastic tube 61 connecting the joint 2*b* and the auxiliary tank 60 is held in the open state. The ink which has been delivered into the second chamber 22 flows into the first chamber 21 through the passage 22*e* and communication passage 23*x*, as indicated by thick solid-line arrow in FIG. 8B, and as described above with respect to the nozzle purging operation by reference to FIG. 6B. Then, the ink flows through the filter 2*f* into the filter chamber 29, as indicated by broken-line arrow in FIG. 8B, as in the nozzle purging operation. The ink flows from the filter chamber 29 into the reservoir unit 3 through the through-hole 24 (formed through the fixing portion of the base portion 20), as indicated by thick solid-line arrows in FIG. 8C. The ink which has flown into the reservoir unit 3 through the through-hole 31*a* flows into the reservoir 33*x* through the through-hole 32*a*, and into the individual branch passages of the reservoir 33*x*. Subsequently, the ink flows toward the filters 4*f* provided on the upper surface 4*b* of the passage unit 4.

Figure 8B:
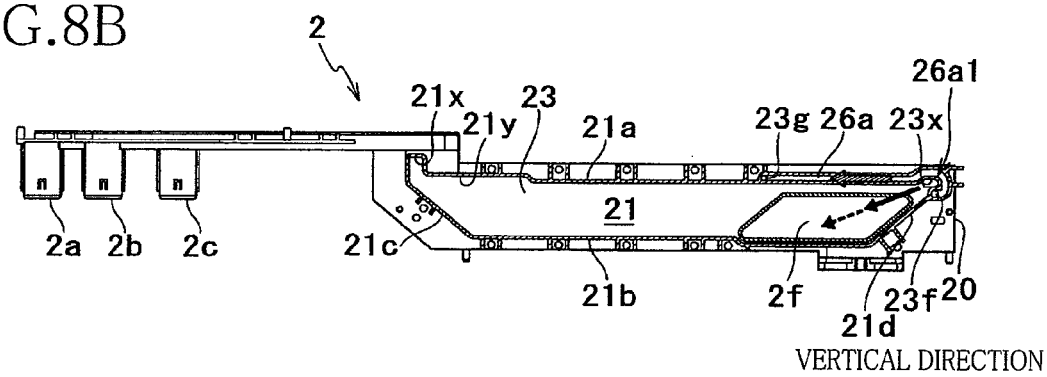
Figure 8C:
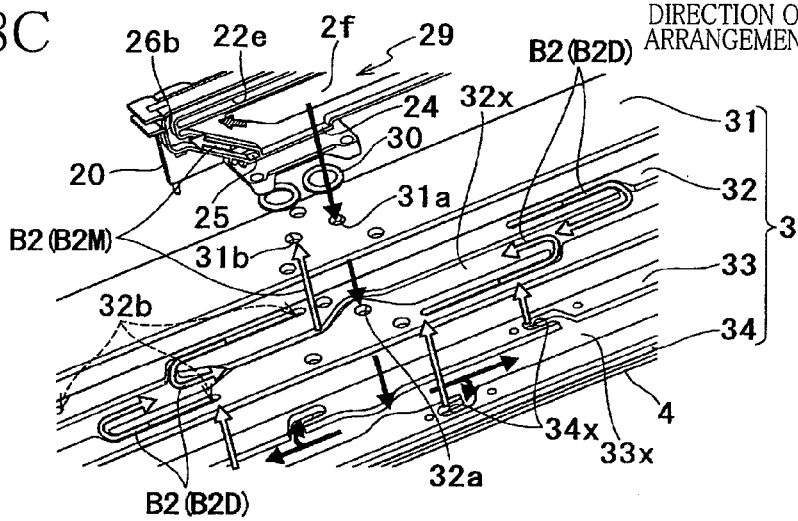

Then, the ink flows upwards through the through-holes 34*x* away from the filters 4*f* on the upper surface 4*b*, and flows through the through-holes 32*b* in the end portions of the branch passages of the reservoir 33*x*, into the recess 32*x* from which the ink flows into the exhaust passage 26*b* through the through-hole 31*b* and through-hole 25, as indicated by white-line arrows in FIG. 8C. The ink which has flown into the exhaust passage 26*b* flows into the connecting passage 7*b* (FIG. 3A) through the opening 26*x*, as indicated by white-line arrows in FIG. 8A, and returns back to the auxiliary tank 60 (FIG. 2) through the joint 2*b*.

The passages through which the ink flows during the inter-filter purging operation from the upper surfaces of the filters 4*f* (upstream-side surfaces as seen in the direction of flow of the ink through the forward passage system F indicated in FIGS. 6A-6C) to a second outlet opening in the form of an opening 2*b*1 of the joint 2*b*, will be collectively referred to as a second return passage system B2, as indicated by the white-line arrows in FIGS. 8A and 8C. The second return passage system B2 is defined by the filter unit 2 and the reservoir unit 3.

A portion of the ink which has flown into the filter chamber 29 during the inter-purging operation flows into the exhaust passage 26*a* through the through-hole 23*f*, and into an intermediate portion of the exhaust passage 26*b* (FIG. 8A) through the through-hole 23*g*, as indicated by hatched-like arrow in FIG. 8C. The ink which has entered into the exhausts passage 26*b* flows into the connecting passage 7*b* (FIG. 3A) through the opening 26*x*, and returns to the auxiliary tank 60 (FIG. 2) through the joint 2*b*, as described above. When air bubbles exist in the filter chamber 29, the air bubbles are discharged into the auxiliary tank 60, together with the ink flowing into the exhaust passage 26*a*.

Each of the ink-jet heads 1 is controlled by the controller 501 (FIG. 1) of the printer 500 to perform the above-described printing operation, nozzle purging operation, circulation purging operation and inter-filter purging operation. In the present printer 500, the purging operations of each ink-jet head 1 are performed at a predetermined regular interval, or upon a predetermined manual operation by the user of the printer 500.

In the ink-jet head 1 constructed as described above according to the illustrated embodiment, the first filter 2*f* and the second filters 4*f* are disposed in series with each other in the forward passage system F such that the first filter 2*f* is located upstream of the second filters 4*f* as seen in the direction of flow of the ink through the forward passage system F, so that the foreign matters existing in the forward passage system F can be effectively captured by the first and second filters 2*f*, 4*f*. Further, the first return passage system B1 (indicated by the thick solid-line arrows in FIG. 7B) is provided for the first filter 2*f*, while the second return passage system B2 (indicated by the white-line arrows in FIGS. 8A and 8C) is provided for the second filters 4*f*, such that the first and second return passage systems B1, B2 are independent of each other. Accordingly, the foreign matters deposited on the first and second filters 2*f*, 4*f* can be effectively discharged through the respective first and second return passage systems B1, B2, by the circulation purging operation described above by reference to FIGS. 7A and 7B, and the inter-filter purging operation described above by reference to FIGS. 8A-8C. Consequently, the amount of the ink required to discharge the foreign matters can be effectively reduced.

In addition, the bypass passage in the form of the exhaust passage 26*a* is provided for communication between the second return passage system B2 (indicated by the white-line arrows in FIGS. 8A and 80), and a partial passage F1 (indicated by the thick solid-line arrows in FIG. 6C) which is a part of the forward passage system F between the first filter 2*f* and the second filters 4*f*. This bypass passage 26*a* permits a reduction in the flow resistance of the partial passage F1, making it possible to reduce a risk of destruction of the meniscus at the liquid-droplet ejecting nozzles even when the inter-filter purging operation of the liquid ejecting head is performed at a relatively high pressure of the ink, to discharge the foreign matters from the partial passage F1 between the first and second filters 2*f*, 4*f*.

If the number of the ink-ejecting nozzles is increased to permit the printing operation of the ink-jet head 1 at an increased speed, the passages formed in the ink-jet head 1 in communication with the nozzles tend to have a comparatively small diameter and a comparatively large length, and consequently have a comparatively high ink flow resistance, which requires a comparatively high ink pressure (e.g., 100 kPa) to perform the nozzle purging operation. The use of a pump having a flow-rate capacity high enough to permit the high-pressure nozzle purging operation causes pressure pulsation of the ink in the passages during an operation of the high flow-rate capacity pump, resulting in a problem of destruction of the meniscus of the nozzles, during the inter-filter purging operation of the ink-jet head 1, in particular. The destruction of the meniscus of the nozzles leads to an unnecessarily large amount of ejection of the ink from the nozzles, namely, an increase in the amount of consumption of the ink, and an undesirable decrease in the purging economy of the ink-jet head 1. In view of the drawback described above, the present ink-jet head 1 is provided with the exhaust passage 26*a* for communication between the partial passage F1 and the exhaust passage 26*b*, in order to reduce a risk of the destruction of meniscus of the nozzles during the high-pressure inter-filter purging operation, making it possible to reduce the amount of consumption of the ink and increase the purging economy of the ink-jet head 1.

The exhaust passage 26*a* has substantially the same ink flow resistance as a main passage system which extends from the filter 2*f* to the positions right above the filters 4*f*, as indicated by the thick solid-line arrows in FIG. 8C, and extending backwards from those positions away from the filters 4*f*, along the second return passage B2, as indicated by the white-line arrows in FIG. 8C, to the through-hole 23*g* formed in the intermediate portion of the exhaust passage 26*b* *a*, namely, to a point of connection between the second return passage B2 and the exhaust passage 26*a*. Accordingly, the rate of flow of the ink through the exhaust passage 26*a* is almost equal to that through the main passage system, permitting even discharging of the foreign matters through the exhaust passage 26*a* and main passage system. For example, the even discharging of the foreign matters is possible through the exhaust passage 26*a* and main passage system, under the conditions of meniscus withstanding pressure of 4-5 kPa; nozzle purging flow rate of 7-8 ml/s; and flow resistance of about 1800 Pa/ml/s of the exhaust passage 26*a* and main passage system. In this case, the destruction of meniscus of the nozzles can be prevented even with the ink pressure pulsation of about 4 ml/s during the operation of the high flow-rate capacity pump.

The filters 4*f* are provided for the respective through-holes 4*x* open in the upper surface 4*b* of the passage unit 4, as shown in FIG. 4, and are disposed in parallel with each other in the forward passage system F (shown in FIGS. 6A-6C). As shown in FIG. 6C, the partial passage F1 includes a main forward passage F1M extending from the back surface of the filter 2*f* (which is exposed to the filter chamber 29 and which is on the downstream side as seen in the above-indicated direction of flow of the liquid through the forward passage system F), and a plurality of branch forward passages F1D branching from the main forward passage F1M toward the respective filters 4*f*. As shown in FIGS. 8A and 8C, the second return passage system B2 includes a main return passage B2M communicating with the second outlet opening 2*b*1, and a plurality of branch return passages B2D which branch from the main return passage B2M toward the respective filters 4*f* and each of which communicates at one of opposite ends thereof with a corresponding one of the plurality of branch forward passages F1D through the through-holes 32*b*. This arrangement permits effective discharging of the foreign matters from the partial passage F1 between the first filer 2*f* and the second filters 4*f*, during the inter-filter purging operation of the ink-jet head 1.

The main forward passage F1M extends in the vertical direction, as shown in FIG. 6C. Accordingly, the foreign matters existing in the main forward passage F1M and the branch forward passages F1D move upwards through the main forward passage F1M due to a force of floating of air bubbles and gather near the back surface of the filter 2*f* on the downstream side, so that the thus gathering foreign matters can be easily discharged through the exhaust passage 26*a* during the inter-filter purging operation of the liquid ejecting head.

Each of the branch return passages B2D is held in communication at one of its opposite ends with a corresponding one of the branch forward passages F1D through the through-hole 32*b*, at a position opposed to a corresponding one of the second filters 4*f* (shown in FIG. 4) in the vertical direction, as shown in FIG. 8C. Namely, the point of communication between each branch return passage B2D and the corresponding branch forward passage F1D is located right above the corresponding filter 4*f*, so that the foreign matters can be effectively discharged owing to the force of floating of the air bubbles.

The exhaust passage 26*a* is held in communication with the partial passage F1, at a portion of the partial passage F1 which is near the back surface of the filter 2*f* on the downstream side, as shown in FIGS. 8A-8C. In the present embodiment, the exhaust passage 26*a* is held in communication with the filter chamber 29 through the through-hole 23*f*. The foreign matters existing in the exhaust passage 26*a* between the filters 2*f*, 4*f* tend to gather near the above-indicated surface of the filter 21. Accordingly, the communication of the exhaust passage 26*a* with the partial passage F1 at its above-indicated portion of the partial passage F1 permits effective discharging of the foreign matters from the partial passage F1 between the filters 2*f*, 4*f*.

The exhaust passage 26*a* has an air-bubble accommodating space 26*a*1 for temporarily accommodating air bubbles contained in the ink, as shown in FIG. 8B. This air-bubble accommodating space 26*a*1 is located above the above-indicated portion of the partial passage F1. The exhaust passage 26*a* extends in the horizontal direction above the through-hole 23*f*, and one end portion of the exhaust passage 26*a* is curved upwardly so as to form the air-bubble accommodating space 26*a*1, which has a higher position than the other portion of the exhaust passage 26*a*, for temporarily accommodating the air bubbles. In this arrangement, a risk of destruction of the meniscus of the ink-ejecting nozzles can be reduced owing to a damping effect of the air bubbles accommodated in the air-bubble accommodating space 26*a*1, even when the inter-filter purging operation of the ink-jet head 1 is performed at a high ink pressure. The air bubbles existing in the filter chamber 29 gather together in an upper portion of the filter chamber 29 due to a floating force of the air bubbles, when the ink-ejecting surface 4*a* faces downwards. The through-hole 23*f* open to an upper corner of the filter chamber 29 permits almost all of the air bubbles to move from the filter chamber 29 into the air-bubble accommodating space 26*a*1. Thus, the air bubbles are unlikely to remain in the filter chamber 29, so that the air bubbles do not move toward the ink-ejecting nozzles during at least the printing operation of the ink-jet head 1.

The filter 2*f* is disposed so as to extend in the vertical direction, in parallel with the partition wall 23, so that the surface area of the filter 2*f* can be increased to improve its function of capturing the foreign matters, without a considerable increase in the size of the ink-jet head 1 in the horizontal direction. Further, the foreign matters are likely to gather in an upper portion of the filter accommodating space (consisting of the first chamber 21 and the filter chamber 29), owing to a force of floating of the air bubbles contained in the ink in the filter accommodating space 21, 29, so that the foreign matters can be efficiently discharged from the filter accommodating space 21, 29, owing to the vertical extension of the filter 2*f* and the force of floating of the air bubbles. In addition, unlike the horizontal extension of the filter 2*f*, the vertical extension is effective to prevent clogging of the filter 2*f* with the foreign matters.

The filter 2*f* is located below the upper wall 22*a* (more precisely, the wall between the filter chamber 29 and the passage 22*e*) such that a gap space is left in the vertical direction between the filter 2*f* and the upper wall 22*a*, as shown in FIG. 8A. In this arrangement, the foreign matters existing in the filter chamber 29 are likely to gather in an upper part of the filter chamber 29, that is, in the gap space above the filter 2*f*, owing to a force of floating of air bubbles, as indicated by a hatched-line arrow in FIG. 8A, so that the foreign matters can be efficiently discharged from the filter chamber 29, and are unlikely to remain on the filter 2*f*, that is, unlikely to clog the filter 2*f*.

The filter chamber 29 is held in communication with the exhaust passage 26*a* through the through-hole 23*f* formed between the filter 2*f* and the upper wall 22*a* in the vertical direction, as shown in FIGS. 8A and 8B, so that the foreign matters are moved from the filter chamber 29 into the exhaust passage 26*a* through the through-hole 23*f*, owing to a force of floating of air bubbles contained in the ink in the filter chamber 29, whereby the foreign matters can be effectively discharged from the filter chamber 29.

The filter accommodating space consisting of the first chamber 21 and the filter chamber 29 is partially defined by the flexible films 27 opposed to the partition wall 23 and the filter 2*f* in the horizontal direction. In this arrangement, the filter accommodating space functions as a pressure damper which effectively prevents destruction of the meniscus of the ink-ejecting nozzles. Since the flexible films 27 are disposed so as to extend in the vertical direction, the surface area of the flexible films 27 can be increased to improve their damping effect, without a considerable increase in the size of the ink-jet head 1 in the horizontal direction.

While the preferred embodiment of the present invention has been described above by reference to the drawings, for illustrative purpose only, it is to be understood that the present invention is not limited to the details of the illustrated embodiment, but may be embodied with various changes and modifications, which may occur to those skilled in the art, without departing from the spirit and scope of the invention defined in the appended claims.

In the illustrated embodiment, the filter 2*f* is accommodated in a space in the form of the first and second chambers 21, 22 each of which is partially defined by the laminar structure consisting of the flexible film 27 and the metal sheet 28, as shown in FIG. 3B. However, the laminar structure may be replaced by the flexible film 27 or any other member.

The shapes and positions of the filters 2*f*, 4*f* are not limited to those in the illustrated embodiment. For example, the filter 2*f* may have any shape other than the parallelogram shape as seen in the direction of arrangement of the two chambers 21, 22. Further, the filter 2*f* disposed below the upper wall 21*a* in the illustrated embodiment may be disposed in contact with the upper wall 21*a*, and the filters 4*f* having a circular shape in the illustrated embodiment may have any other shape corresponding to that of the through-holes 4*x*.

Although the partition wall 23 and filter 2*f* of the ink-jet head 1 according to the illustrated embodiment are disposed so as to extend in the vertical direction, the partition wall and filter may be disposed so as to extend in any direction which intersects the horizontal direction and which is inclined with respect to the vertical direction. The filter 2*f* may be disposed so as to extend in the horizontal direction.

In the illustrated embodiment, the first filter in the form of the filter 2*f* is accommodated in the filter unit 2 such that the filter 2*f* is disposed so as to extend in the vertical direction. However, the ink-jet head 1 need not include the filter unit 2, provided the first filter is disposed in a suitably shaped portion of the forward passage system which is upstream of the second filter, such that the first filter is disposed so as to extend in a direction intersecting the direction of flow of the liquid through the forward passage system F.

The main forward passage F1M need not extend in the vertical direction, but may extend in any direction intersecting the vertical direction.

In the illustrated embodiments, the positions of communication between the branch return passages B2D and the branch forward passages F1D are opposed to the respective filters 4*f* in the vertical direction. However, the positions of communication need not be opposed to the filters 4*f* in the vertical direction.

Although the plurality of second filters 4*f* are disposed in the forward passage system F, in parallel with each other, in the illustrated embodiment, only one second filter may be disposed. In this case, the forward passage system F need not include the main forward passage F1M and the branch forward passages F1D, and the second return passage system B2 need not include the main return passage B2M and the branch return passages B2D.

The shapes and sizes of the forward passage system F, first return passage system B1, second return passage system B2 and bypass passages 26*a*, 26*b* are not limited to those in the illustrated embodiment. For instance, the bypass passages may be configured so as not to include a space in which the air bubbles are accumulated.

The bypass passages 26*a*, 26*b* may be connected to the partial passage F1M and second return passage system B2, at any desired positions. In the illustrated embodiment, the bypass passages have substantially the same value of flow resistance as the forward passage system F and first and second return passage systems B1, B2. However, the bypass passages may have any flow resistance value. Further, the bypass passages may be eliminated.

While the first and second return passage systems B1, B2 are completely independent from each other in the illustrated embodiment, the two return passage systems B1, B2 may have at least one common portion.

The liquid ejecting head according to the present invention may be of either a line printing type or a serial printing type, and may be used in an apparatus other than the printer, for example, in a facsimile or copying apparatus. The liquid ejecting head of the invention may use a liquid other than an ink.

Although the ink-jet head 1 according to the illustrated embodiment of this invention uses the piezoelectric actuator units 5 configured to eject the liquid from the nozzles, the ink-jet head may use other types of actuator such as an electrostatic type and a resistor-heating thermal type.

What is claimed is:

1. A liquid ejecting head comprising:

a forward passage system configured to direct a forward flow of a liquid from an inlet opening to which the liquid is supplied from a liquid supply source to a plurality of liquid-droplet ejecting nozzles;

a first filter and at least one second filter disposed in series with each other in the forward passage system to capture foreign matters contained in the liquid, wherein the first filter is located upstream of the at least one second filter in a direction of the forward flow of the liquid through the forward passage system, wherein the first filter comprises a first-upstream-side surface and a first-downstream-side surface in the direction of the forward flow, and wherein each of the at least one second filter comprises a second-upstream-side surface and a second-downstream-side surface in the direction of the forward flow;

a first return passage system configured to direct a first flow of the liquid from the first-upstream-side surface to a first outlet opening from which the liquid is discharged without passing through the first filter, the first outlet opening being different from the inlet opening; and a second return passage system configured to direct a second flow of the liquid from the second-upstream-side surface to a second outlet opening from which the liquid is discharged without passing through the at least one second filter, the second outlet opening being different from the first outlet opening.

2. The liquid ejecting head according to claim 1, further comprising a bypass passage for communication between the second return passage system, and a partial passage which is a part of the forward passage system between the first filter and the at least one second filter.

3. The liquid ejecting head according to claim 2, wherein the at least one second filter comprises a plurality of second filters disposed in parallel with each other in the forward passage system, and the partial passage comprises a main forward passage extending from the first-downstream-side surface of the first filter, wherein a plurality of branch forward passages branch from the main forward passage toward the respective second filters, and wherein the second return passage system comprises a main return passage in communication with the second outlet opening, wherein a plurality of branch return passages branch from the main return passage toward the respective second filters and each of the at least one second filter communicates at one of opposite ends thereof with a corresponding one of the plurality of branch forward passages.

4. The liquid ejecting head according to claim 3, wherein the main forward passage extends in a vertical direction when droplets of the liquid are ejected downwards in the vertical direction from the liquid-droplet ejecting nozzles.

5. The liquid ejecting head according to claim 3, wherein each of the branch return passages is held in communication at one of opposite ends thereof with a corresponding one of the branch forward passages, at a position opposed to a corresponding one of the second filters in a vertical direction when droplets of the liquid are ejected downwards in the vertical direction from the liquid-droplet ejecting nozzles.

6. The liquid ejecting head according to claim 2, wherein the bypass passage is held in communication with the partial passage, at a portion of the partial passage which is near the first-downstream-side surface of the first filter.

7. The liquid ejecting head according to claim 6, wherein the bypass passage has an air-bubble accommodating space for temporarily accommodating air bubbles contained in the liquid, the air-bubble accommodating space being located above said portion of the partial passage when droplets of the liquid are ejected downwards in the vertical direction from the liquid-droplet ejecting nozzles.

8. The liquid ejecting head according to claim 1, wherein the forward passage system comprises a filter accommodating space in which the first filter is disposed and which is partially defined by a planar partition wall to which the first filter is fixed and which extends in a vertical direction when droplets of the liquid are ejected downwards in the vertical direction from the liquid-droplet ejecting nozzles, and wherein the filter accommodating space comprises an upstream portion and a downstream portion which are arranged in a horizontal direction such that the filter accommodating space is divided by the planar partition wall into the upstream and downstream portions and such that the upstream portion is located upstream of the downstream portion in the direction of the forward flow of the liquid.

9. The liquid ejecting head according to claim 8, wherein the downstream portion is partially defined by an upper wall, and the first filter is located below the upper wall such that a gap space is left in the vertical direction between the first filter and the upper wall when the droplets of the liquid are ejected downwards in the vertical direction from the liquid-droplet ejecting nozzles.

10. The liquid ejecting head according to claim 9, further comprising: a bypass passage for communication between the second return passage system, and a partial passage which is a part of the forward passage system between the first filter and the at least one second filter; and a through-hole formed between the first filter and the upper wall in the vertical direction when the droplets of the liquid are ejected downwards in the vertical direction from the liquid-droplet ejecting nozzles, and wherein the downstream portion is held in communication with the bypass passage through the through-hole.

11. The liquid ejecting head according to claim 8, wherein the filter accommodating space is partially defined by a flexible film opposed to the planar partition wall and the first filter in the horizontal direction.

* * * * *